US007959472B1

(12) United States Patent
Huang

(10) Patent No.: US 7,959,472 B1
(45) Date of Patent: Jun. 14, 2011

(54) AUDIO JACK CONNECTOR

(75) Inventor: Sheng-Yuan Huang, Tu-Cheng (TW)

(73) Assignee: Cheng UEI Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/688,682

(22) Filed: Jan. 15, 2010

(51) Int. Cl.
*H01R 24/04* (2006.01)

(52) U.S. Cl. ..... 439/668

(58) Field of Classification Search ..... 439/668, 439/669, 660, 638
See application file for complete search history.

(56) References Cited

U.S. PATENT DOCUMENTS 3,435,163 A * 3/1969 Lutzenberger et al. ..... 200/51.1
4,398,784 A * 8/1983 Takihara ..... 439/668
4,598,970 A * 7/1986 Takihara ..... 439/668
6,368,156 B1 * 4/2002 Lin ..... 439/668
6,637,946 B2 * 10/2003 Cheng ..... 385/77
6,869,315 B2 * 3/2005 Nakai et al. ..... 439/668
7,789,712 B1 * 9/2010 Peng et al. ..... 439/668
7,794,285 B1 * 9/2010 Huang ..... 439/668

* cited by examiner

*Primary Examiner* — T C Patel
*Assistant Examiner* — Harshad C Patel
(74) *Attorney, Agent, or Firm* — Cheng-Ju Chiang

(57) ABSTRACT

An audio jack connector adapted for receiving an audio plug connector with a tip end includes an insulating housing and a contact terminal. The insulating housing defines a plug insertion hole from a front end to a rear end thereof and a recess communicating with the plug insertion hole. The contact terminal has a connecting portion received in a rear of the recess. Two opposite ends of the connecting portion are extended downward to form first and second holding arms. Portions of the holding arms extend along the axis of the plug insertion hole to form first and second locating boards. Edges of the locating boards extend towards each other and are bent along the axis of the plug insertion hole to form first and second elastic arms. First and second contact portions are protruded into the plug insertion hole from free ends of the elastic arms.

3 Claims, 5 Drawing Sheets

AUDIO JACK CONNECTOR

BACKGROUND OF THE INVENTION

1. Field of the Invention

The present invention generally relates to an electrical connector, and more particularly to an audio jack connector.

2. The Related Art

Referring to FIG. 7, a conventional audio jack connector 4 for mating with an audio plug connector 5 includes an insulating housing 41 and a plurality of terminals disposed in the insulating housing 41. The terminals include a plurality of spring terminals 421 and a contact terminal 422 disposed in the insulating housing 41 for contacting the audio plug connector 5, respectively. The insulating housing 41 defines a plug insertion hole 411 from a front end to a rear end thereof to receive the audio plug connector 5. The contact terminal 422 has a base portion 4221 disposed in a rear end of the plug insertion hole 411 of the insulating housing 41, a soldering portion 4222 exposed out of the plug insertion hole 411 to be soldered with a printed circuit board (not shown) and a contact portion 4223 stretching into the plug insertion hole 411 for contacting with the audio plug connector 5 at a side of the audio plug connector 5. However, when the audio plug connector 5 is inserted with force in a direction oblique to the axis of the plug insertion hole 411, the audio plug connector 5 is apt to tilt to a side of the plug insertion hole 411 so that make an electrical connection between the audio jack connector 4 and the corresponding audio plug connector 5 unstable.

SUMMARY OF THE INVENTION

An object of the invention is to provide an audio jack connector for receiving an audio plug connector with a tip end. The audio jack connector includes an insulating housing and a plurality of terminals disposed in the insulating housing. The insulating housing defines a plug insertion hole from a front end to a rear end thereof for receiving the audio plug connector and a recess communicating with a rear end of the plug insertion hole. The terminals include a contact terminal received in the recess and having a connecting portion received in a rear of the recess and located over the tip end of the audio plug connector when the audio plug connector is inserted into the plug insertion hole. Two opposite ends of the connecting portion are extended downward to form a first holding arm and a second holding arm facing each other and abutting against two opposite sidewalls of the recess respectively. A portion of the first holding arm and a portion of the second holding arm extend along the axis of the plug insertion hole to form a first locating board and a second locating board respectively. An edge of the first locating board and an edge of the second locating board extend towards each other and then are bent along the axis of the plug insertion hole to form a substantially inverse L-shaped first elastic arm and a substantially inverse L-shaped second elastic arm paralleling to the first elastic arm. A first contact portion and a second contact portion are protruded into the plug insertion hole from free ends of the first elastic arm and the second elastic arm, respectively, for abutting against two opposed sides of the tip end of the audio plug connector.

As described above, the audio jack connector utilizes the contact terminal for making the audio plug connector disposed in the plug insertion hole of the insulating housing of the audio jack connector firmly by means of the first contact portion and the second contact portion abutting against two opposed sides of the tip end of the audio plug connector so as to form a steady electrical connection between the audio jack connector and the corresponding audio plug connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
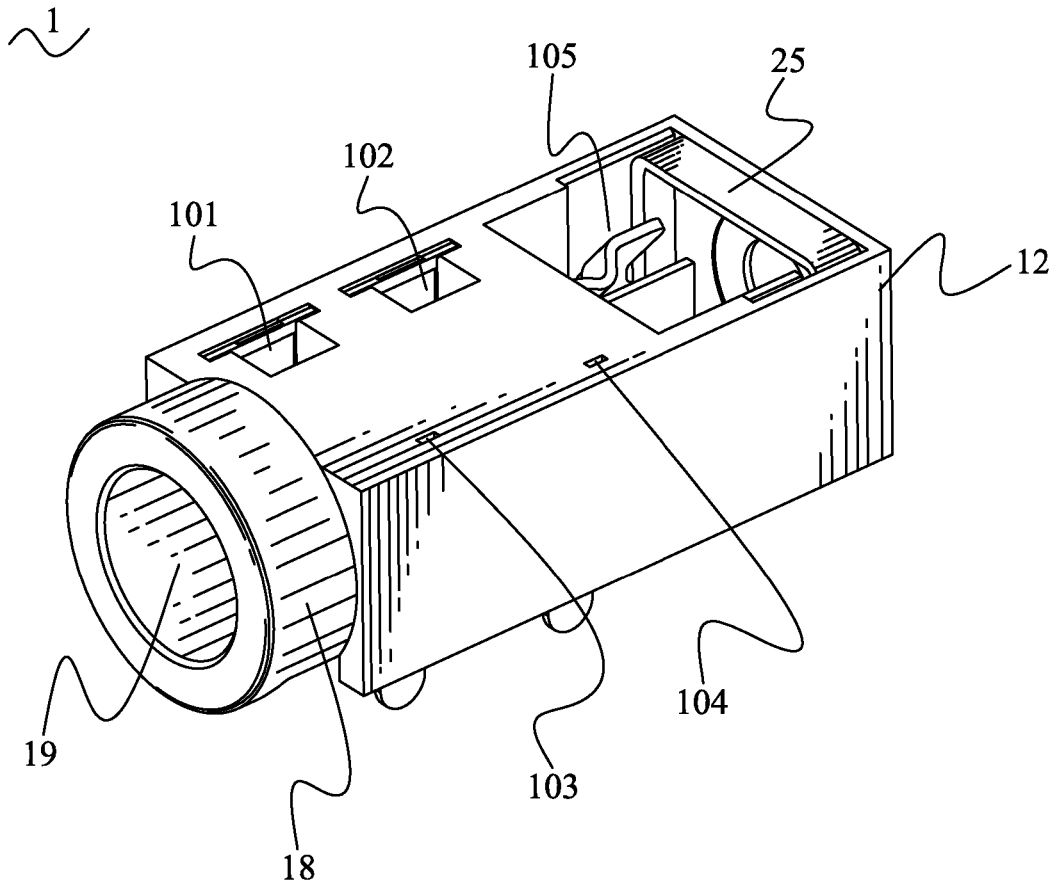
FIG. 1 is a perspective view of an audio jack connector in accordance with the present invention.
Figure 2:
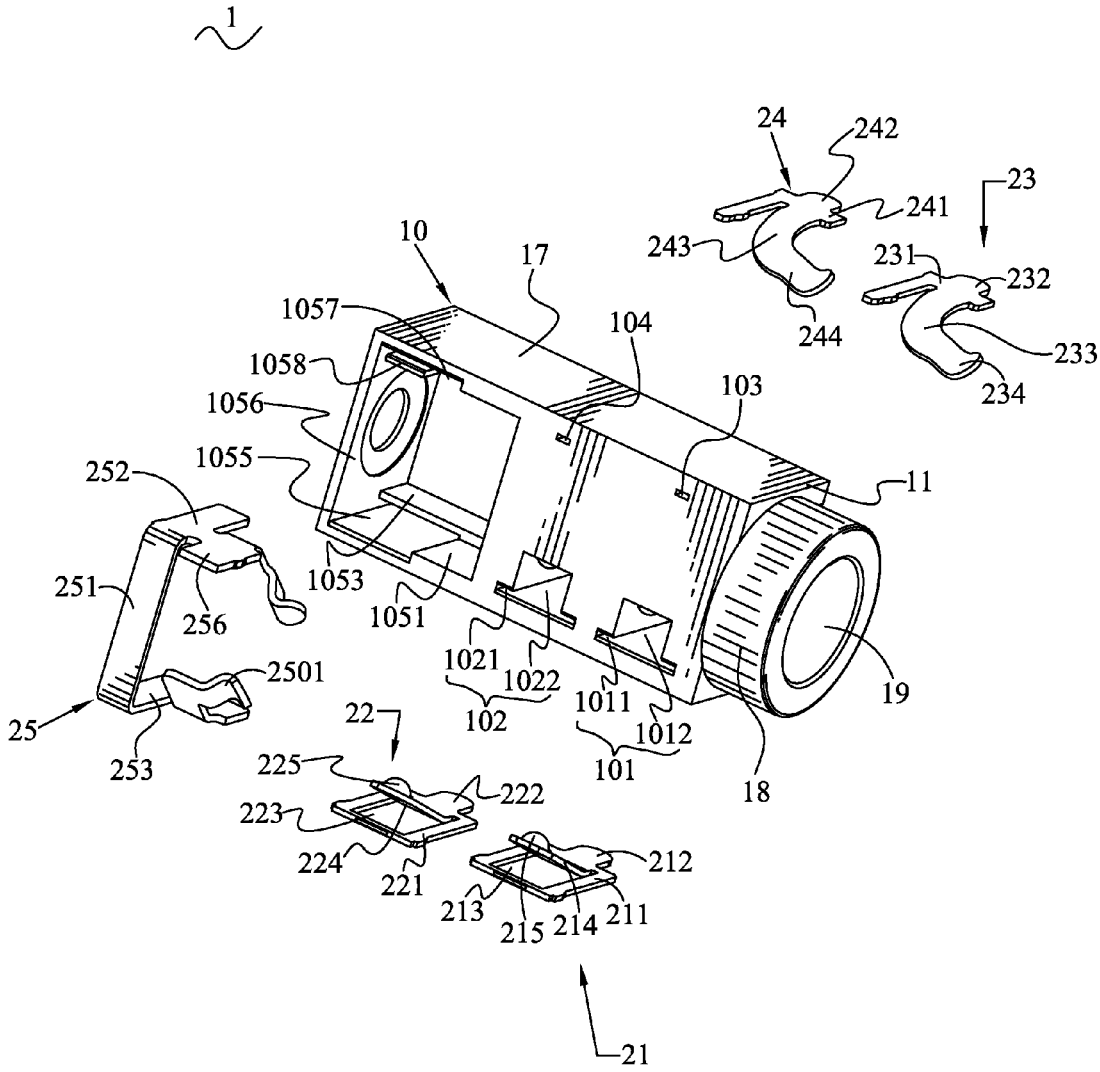
FIG. 2 is an exploded view of the audio jack connector of FIG. 1.
Figure 3:
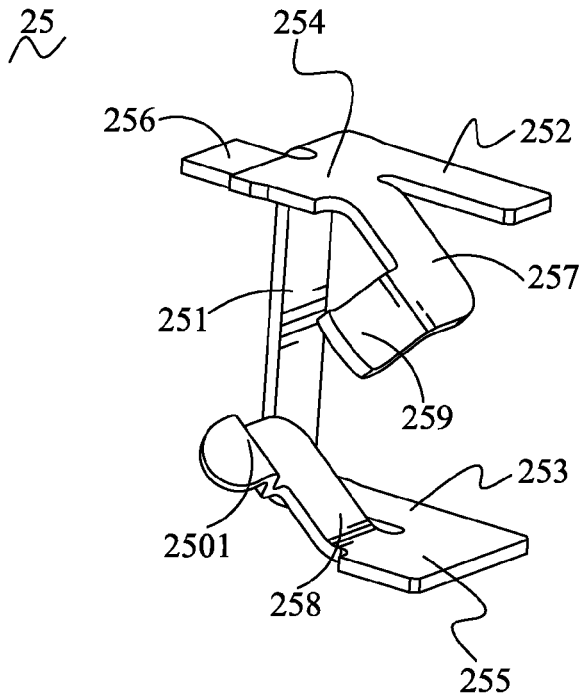
FIG. 3 is a perspective view of a contact terminal of the audio jack connector of FIG. 1.
Figure 4:
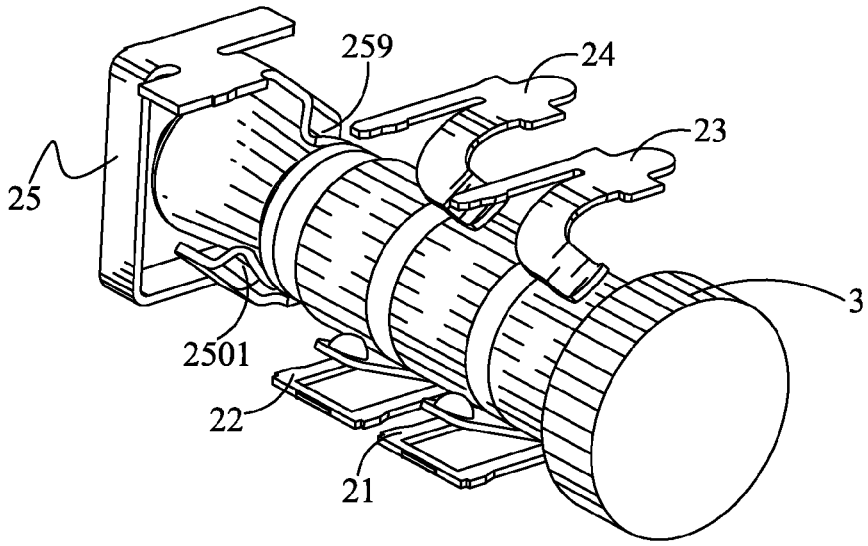
FIG. 4 is a perspective view of a plurality of terminals of the audio jack connector of FIG. 1, showing the terminals contacting with an audio plug connector.
Figure 5:
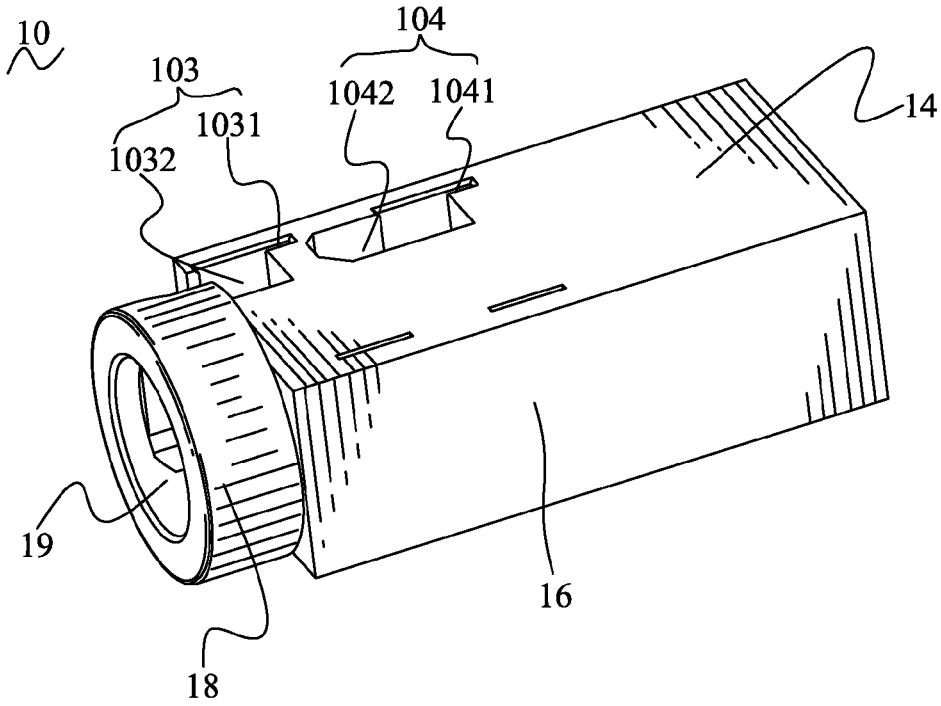
FIG. 5 is a perspective view of an insulating housing of the audio jack connector of FIG. 1.
Figure 6:
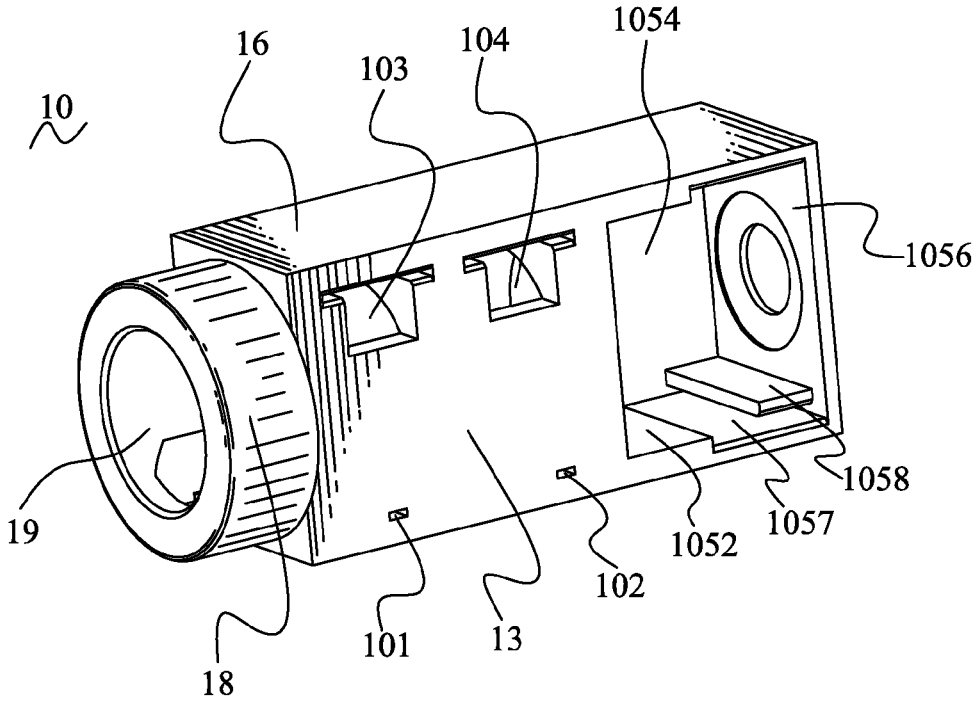
FIG. 6 is another perspective view of the insulating housing of the audio jack connector of FIG. 1.
Figure 7:
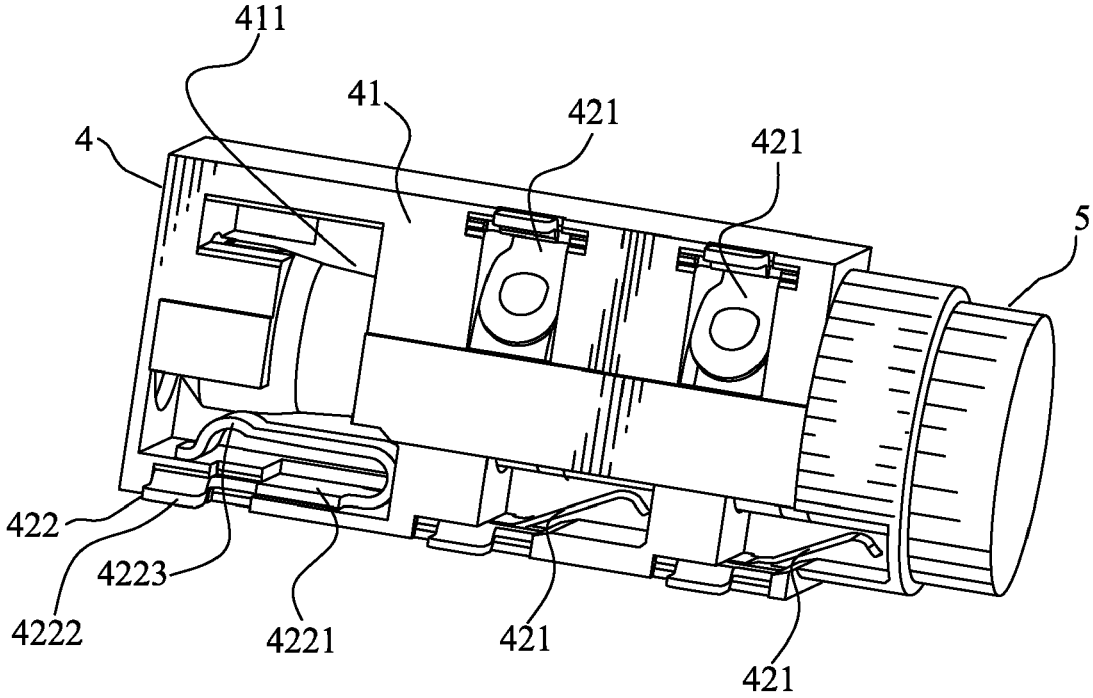
FIG. 7 (Prior Art)
FIG. 7 is a perspective view of an audio jack connector according to a prior art, in which an audio plug connector is inserted.

Referring to FIGS. 1-2 and FIG. 4, an audio jack connector 1 according to the present invention is shown. The audio jack connector 1 includes an insulating housing 10 and a plurality of terminals disposed in the insulating housing 10. Herein, supposing an audio plug connector 3 with a tip end is inserted into the audio jack connector 1 along a front and rear inserting direction, for clear description.

Referring to FIGS. 1-2 and FIGS. 5-6, the insulating housing 10 is of a substantially rectangular shape and defines a front end 11, a rear end 12 opposite to the front end 11, a top surface 13, a bottom surface 14 opposite to the top surface 13, a first lateral surface 16 and a second lateral surface 17 opposite to the first lateral surface 16. The front end 11 has a substantial middle portion protruded outwards to form a circular platform 18. A plug insertion hole 19, with a circular cross-section, is formed in the insulating housing 10 and passes through middle portions of the platform 18 and the rear end 12 of the insulating housing 10 for receiving the mating audio plug connector 3 from a front portion thereof. The insulating housing 10 defines a first groove 101, a second groove 102, a third groove 103, a fourth groove 104 and a recess 105.

The first groove 101 has a first fixing groove 1011 located at a front portion of the top surface 13 adjacent to the first lateral surface 16 and extending longitudinally to pass through the bottom surface 14. The top surface 13 further defines a rectangular first receiving cavity 1012 extending transversely to connect with a middle of the first fixing groove 1011 and communicating with the plug insertion hole 19. The second groove 102 is of the same structure as the first groove 101 and located in rear of the first groove 101. The second groove 102 and the first groove 101 are aligned with each other along a longitudinal direction. The second groove 102 has a second fixing groove 1021 and a second receiving cavity 1022. The third groove 103 has a rectangular third fixing groove 1031 located at a front portion of the bottom surface 14 adjacent to the second lateral surface 17 and extending longitudinally to pass through the top surface 13 of the insulating housing 10. The bottom surface 14 further defines a third receiving cavity 1032 extending transversely to communicate with the third fixing groove 1031 and the plug insertion hole 19. The third receiving cavity 1032 connects with a side end of the third fixing groove 1031 and biased from the third fixing groove 1031. The fourth groove 104 is of the same structure as the third groove 103 and located in rear of the third groove 103. The third groove 103 and the fourth groove 104 are aligned with each other along the longitudinal direction. The fourth groove 104 has a fourth fixing groove 1041 and a fourth receiving cavity 1042.

The recess 105 communicates with the plug insertion hole 19 at a rear end thereof and passes through the top surface 13 of the insulating housing 10. A portion of a first sidewall 1051 of the recess 105 is protruded towards a second sidewall 1052 of the recess 105 which is opposite to the first sidewall 1051 to form a substantially rectangular holding block 1053 extending vertically and longitudinally to reach to a bottom wall 1054 and a rear wall 1056 of the recess 105 respectively. The first sidewall 1051 defines a substantially rectangular holding groove 1055 extending vertically to pass through the top surface 13 of the insulating housing and reach to the holding block 1053, with a portion of the rear wall 1056 of the recess 105 being defined as an inner wall of the holding groove 1055. The second sidewall 1052 of recess 105 defines a locating groove 1057 extending vertically to pass through the top surface 13, with a portion of the rear wall 1056 being defined as an inner wall of the locating groove 1057. A portion of the rear wall 1056 of the recess 105 which is adjacent to the second sidewall 1052 is protruded towards the recess 105 along the axis of the plug insertion hole 19 to form a preventing board 1058 paralleling to the second sidewall 1052 and located at a side of the locating groove 1057.

Referring to FIGS. 1-6, the terminals received in the insulating housing 10 are divided into a first terminal group, a second terminal group and a contact terminal 25. The first terminal group includes a first terminal 21 and a second terminal 22, which are received in the first groove 101 and the second groove 102, respectively. The first terminal 21 has a rectangular first fixing board 211 disposed vertically and fixed in the first fixing groove 1011 of the first fixing groove 101. An edge of the first fixing board 211 extends downward to form a first soldering portion 212. A middle of the first fixing board 211 defines a first opening 213 transversely passing therethrough. An inner edge of the first opening 213 which is adjacent to the first soldering portion 212 extends obliquely to form a first elastic portion 214 located at a side of the first fixing board 211. A tip end of the first elastic portion 214 protrudes opposite to the first fixing board 211 to form a first contact lump 215. The first soldering portion 212 is exposed outside the bottom surface 14 to be soldered with a printed circuit board (not shown). The first elastic portion 214 is received in the first receiving cavity 1012 and stretches into the plug insertion hole 19 for making the first contact lump 215 on the first elastic portion 214 being able to contact with the mating audio plug connector 3. The second terminal 22 is of the same structure as the first terminal 21. The second terminal 22 has a second fixing board 221 fixed in the second fixing groove 1021 of the second groove 102, a second soldering portion 222 exposed outside the bottom surface 14 to be soldered with the printed circuit board, a second opening 223 and a second elastic portion 224 received in the second receiving cavity 1022 and stretching into the plug insertion hole 19 so as to make a second contact lump 225 on the second elastic portion 224 being able to contact with the mating audio plug connector 3.

The second terminal group includes a third terminal 23 and a fourth terminal 24, which are received in the third groove 103 and the fourth groove 104, respectively. The third terminal 23 has a third fixing board 231 extending transversely and disposed vertically. A bottom edge of the third fixing board 231 extends downward to form a third soldering portion 232. A top edge of the third fixing board 231 extends obliquely to form a third elastic portion 233 higher than the third fixing board 231. A first contact rib 234 is formed by a free end of the third elastic portion 233 being arched into the plug insertion hole 19. The third fixing board 231 is fixed in the third fixing groove 1031 of the third groove 103. The third soldering portion 232 is exposed outside of the top surface 13 to be soldered with the printed circuit board. The third elastic portion 233 is received in the third receiving cavity 1032 and stretches into the plug insertion hole 19 for making the first contact rib 234 on the third elastic portion 233 being able to contact with the mating audio plug connector 3. The fourth terminal 24 is of the same structure as the third terminal 23. The fourth terminal 24 has a fourth fixing board 241 fixed in the fourth fixing groove 1041 of the fourth groove 104, a fourth soldering portion 242 exposed outside the top surface 13 to be soldered with the printed circuit board and a fourth elastic portion 243 received in the fourth receiving cavity 1042 and stretching into the plug insertion hole 19 so as to make the fourth contact rib 244 on the fourth elastic portion 243 being able to contact with the mating audio plug connector 3.

The contact terminal 25 is received in the recess 105. The contact terminal 25 has a rectangular connecting portion 251 received in a rear of the recess 105 and located over the tip end of the audio plug connector 3 when the audio plug connector 3 is inserted in the plug insertion hole 19 of the insulating housing 10. Two opposite ends of the connecting portion 251 are extended downward to form a first holding arm 252 and a second holding arm 253 facing each other. A portion of a side edge of the first holding arm 252 which is adjacent to the connecting portion 251 is extended along the axis of the plug insertion hole 19 to form a substantially rectangular first locating board 254. A portion of a side edge of the second holding arm 253 which is far away from the connecting portion 251 is extended along the same direction as the first locating board 254 to form a substantially rectangular second locating board 255. A top edge of the first locating board 254 extends upward to form a fifth soldering portion 256 beyond the connecting portion 251. A bottom edge of the first locating board 254 extends obliquely towards the second locating board 255 and then bent along the axis of the plug insertion hole 19 to form a substantially inverse L-shaped first elastic arm 257. A top edge of the second locating board 255 extends obliquely towards the first locating board 254 and then bent along the axis of the plug insertion hole 19 to form a substantially inverse L-shaped second elastic arm 258 paralleling to the first elastic arm 257. A first contact portion 259 is formed by a free end of the first elastic arm 257 being arched into the plug insertion hole 19 towards the second elastic arm 258. A second contact portion 2501 is formed by a free end of the second elastic arm 258 being arched into the plug insertion hole 19 towards the first elastic arm 257. The first holding arm 252 and the first locating board 254 are held in the locating groove 1057 of the recess 105. The first holding arm 252 is further restricted between a side surface of the locating groove 1057 and the preventing board 1058 for ensuring a firm engagement between the contact terminal 25 and the insulating housing 10. The second holding arm 253 and the second locating board 255 are located in the holding groove 1055. The second locating board 255 and part of the second holding arm 253 are further restricted by the holding block 1053 for ensuring a firm engagement between the contact terminal 25 and the insulating housing 10. The first elastic arm 257 and the second elastic arm 258 are located between the holding block 1053 and the preventing board 1058. The contact portions 259, 2501 stretch into the plug insertion hole 19 for contacting with the tip end of the audio plug connector 3 in an embracing fashion. The fifth soldering portion 256 is exposed outside the top surface 13 for being soldered with the printed circuit board.

Referring to FIGS. 1-6, in use, when the corresponding audio plug connector 3 is completely inserted into the plug insertion hole 19 of the insulating housing 10 of the audio jack connector 1. The contact lumps 215, 225, the contact ribs 234, 244 and the contact portions 259, 2501 will electrically contact with the corresponding audio plug connector 3, which makes audio signals transmit between the audio jack connector 1 and the mating audio plug connector 3. At the same time, due to elastic deformation of the elastic arms 257, 258, there is a contact pressure with respect to the audio plug connector 3 so that a favorable elastic spring force can be attained. The first contact portion 259 and the second contact portion 2501 of the contact terminal 25 abut against two opposed sides of the tip end of the corresponding audio plug connector 3 in an embracing fashion for preventing the audio plug connector 3 from being tilted to a side of the plug insertion hole 19 so as to form a steady electrical connection between the audio jack connector 1 and the corresponding audio plug connector 3.

As described above, the audio jack connector 1 utilizes the contact terminal 25 for making the audio plug connector 3 disposed in the plug insertion hole 19 of the insulating housing 10 of the audio jack connector 1 firmly by means of the first contact portion 259 and the second contact portion 2501 abutting against two opposed sides of the tip end of the audio plug connector 3 so as to form a steady electrical connection between the audio jack connector 1 and the corresponding audio plug connector 3.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An audio jack connector for receiving an audio plug connector with a tip end, comprising:

an insulating housing defining a plug insertion hole from a front end to a rear end thereof for receiving the audio plug connector and a recess communicating with a rear end of the plug insertion hole; and a plurality of terminals disposed in the insulating housing, the terminals including a contact terminal received in the recess and having a connecting portion received in a rear of the recess and located over the tip end of the audio plug connector when the audio plug connector is inserted into the plug insertion hole, two opposite ends of the connecting portion being extended downward to form a first holding arm and a second holding arm facing each other and abutting against two opposite sidewalls of the recess respectively, a portion of the first holding arm and a portion of the second holding arm extending along the axis of the plug insertion hole to form a first locating board and a second locating board respectively, an edge of the first locating board and an edge of the second locating board extending towards each other and then being bent along the axis of the plug insertion hole to form a substantially inverse L-shaped first elastic arm and a substantially inverse L-shaped second elastic arm paralleling to the first elastic arm, a first contact portion and a second contact portion being protruded into the plug insertion hole from free ends of the first elastic arm and the second elastic arm, respectively, for abutting against two opposed sides of the tip end of the audio plug connector;

wherein a sidewall of the recess defines a holding groove extending vertically, an opposite sidewall of the recess defines a locating groove extending vertically, a portion of the sidewall of the recess protrudes towards the opposite sidewall to form a holding block, the holding groove further extends into the holding block, a portion of a rear wall of the recess protrudes towards the recess to form a preventing board located at a side of the locating groove, and the first holding arm and the second holding arm are held in the locating groove and the holding groove, respectively, and further restricted by the preventing board and the holding block, respectively.

2. The audio jack connector as claimed in claim 1, wherein the first contact portion and the second contact portion are formed by the free ends of the first elastic arm and the second elastic arm being arched into the plug insertion hole, respectively.

3. The audio jack connector as claimed in claim 1, wherein the contact terminal further has a soldering portion extended from the first locating board and beyond the connecting portion to be exposed outside the recess.

* * * * *